US008591180B2

(12) United States Patent
Anderson et al.

(10) Patent No.: US 8,591,180 B2
(45) Date of Patent: Nov. 26, 2013

(54) STEAM TURBINE NOZZLE ASSEMBLY HAVING FLUSH APERTURES

(75) Inventors: James Peter Anderson, Clifton Park, NY (US); Steven Sebastian Burdgick, Schenectady, NY (US); Mark Edward Burnett, Barton, NY (US); Dominick Joseph Werther, Albany, NY (US)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 12/902,709

(22) Filed: Oct. 12, 2010

(65) Prior Publication Data

US 2012/0087788 A1 Apr. 12, 2012

(51) Int. Cl.
*F01D 11/00* (2006.01)

(52) U.S. Cl.
USPC ..... 415/169.1

(58) Field of Classification Search
USPC ..... 415/169.2, 169.3, 191, 211.2, 116, 415/169.1
See application file for complete search history.

(56) References Cited

U.S. PATENT DOCUMENTS

| | | | | |
|---|---|---|---|---|
| 6,010,302 | A * | 1/2000 | Oeynhausen | 415/115 |
| 6,022,190 | A * | 2/2000 | Schillinger | 416/96 R |
| 6,227,799 | B1 * | 5/2001 | Kuhn et al. | 415/115 |
| 7,101,144 | B2 * | 9/2006 | Haje et al. | 415/115 |
| 7,427,187 | B2 | 9/2008 | Burdgick et al. | |
| 8,087,879 | B2 * | 1/2012 | Dejaune et al. | 415/115 |
| 8,381,533 | B2 * | 2/2013 | Smoke et al. | 60/806 |
| 2006/0034685 | A1 * | 2/2006 | Kizuka et al. | 415/191 |
| 2009/0208323 | A1 * | 8/2009 | Bowen et al. | 415/115 |

* cited by examiner

*Primary Examiner* — Edward Look
*Assistant Examiner* — William Grigos
(74) *Attorney, Agent, or Firm* — Hoffman Warnick LLC; Ernest G. Cusick

(57) ABSTRACT

A steam turbine nozzle assembly having a flush aperture is disclosed. In one embodiment, the steam turbine nozzle assembly includes a diaphragm assembly comprising: an inner diaphragm ring segment; an outer diaphragm ring segment; a static nozzle blade positioned between the inner diaphragm ring segment and the outer diaphragm ring segment; and a first cavity between the static nozzle blade and one of the inner diaphragm ring segment or the outer diaphragm ring segment; wherein the one of the inner diaphragm ring segment or the outer diaphragm ring segment includes a first aperture fluidly connected with the first cavity.

15 Claims, 5 Drawing Sheets

STEAM TURBINE NOZZLE ASSEMBLY HAVING FLUSH APERTURES

BACKGROUND OF THE INVENTION

The subject matter disclosed herein relates to a steam turbine nozzle assembly, or diaphragm stage. Specifically, the subject matter disclosed herein relates to a steam turbine nozzle assembly including one or more flush holes (or, apertures) for flushing cavities within the nozzle assembly.

Steam turbines include static nozzle (or "airfoil") segments that direct flow of a working fluid into turbine buckets connected to a rotating rotor. A complete assembly of nozzle segments is commonly referred to as a diaphragm stage, or nozzle assembly, of the steam turbine. Traditional nozzle assembly designs use a band-and-ring construction, while some modern approaches include nozzle segments having integral sidewalls bonded to rings. In either the traditional or modern approaches, cavities may exist between the band and ring, or nozzle sidewall and ring. These cavities may become contaminated, causing life-cycle and/or inefficiency issues in operation of the turbine. Additionally, removing contamination from cavities after operation (and before refurbishing and/or decommissioning) of a steam turbine, e.g., a nuclear steam turbine unit may difficult.

BRIEF DESCRIPTION OF THE INVENTION

A steam turbine nozzle assembly having a flush aperture is disclosed. In one embodiment, the steam turbine nozzle assembly includes: an inner diaphragm ring segment; an outer diaphragm ring segment; a static nozzle blade positioned between the inner diaphragm ring segment and the outer diaphragm ring segment; and a first cavity between the static nozzle blade and one of the inner diaphragm ring segment or the outer diaphragm ring segment; wherein the one of the inner diaphragm ring segment or the outer diaphragm ring segment includes a first aperture fluidly connected with the first cavity.

A first aspect of the invention includes a steam turbine diaphragm assembly comprising: an inner diaphragm ring segment; an outer diaphragm ring segment; a static nozzle blade positioned between the inner diaphragm ring segment and the outer diaphragm ring segment; and a first cavity between the static nozzle blade and one of the inner diaphragm ring segment or the outer diaphragm ring segment; wherein the one of the inner diaphragm ring segment or the outer diaphragm ring segment includes a first aperture fluidly connected with the first cavity.

A second aspect of the invention includes a steam turbine diaphragm assembly comprising: an inner diaphragm ring; an outer diaphragm ring; an annulus of static nozzle blades positioned between the inner diaphragm ring and the outer diaphragm ring; an inner cavity between the annulus of static nozzle blades and the inner diaphragm ring; and an outer cavity between the annulus of static nozzle blades and the outer diaphragm ring; wherein the inner diaphragm ring includes a first aperture fluidly connected with the inner cavity, and the outer diaphragm ring include a second aperture fluidly connected with the outer cavity.

A third aspect of the invention includes a steam turbine diaphragm segment comprising: a first surface configured to couple to a static nozzle blade; a second surface either adjacent to the first surface or opposite the first surface; a body portion located within the first surface and the second surface; and an aperture extending from the second surface to first surface, the aperture configured to direct a fluid through the body portion.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for a steam turbine nozzle apparatus having a flush aperture (or, hole). More specifically, aspects of the invention provide for a steam turbine nozzle apparatus having a plurality of flush apertures for flushing cavities within the assembly.

As indicated above, nozzle assembly designs predominately take one of two forms: 1) traditional nozzle assembly designs, using a band-and-ring construction; and 2) more modern designs, using nozzle segments having integral sidewalls bonded to rings. In either design, cavities exist between the band and ring, or nozzle sidewall and ring. These cavities can become contaminated, e.g., with machining oil during fabrication, moisture, or nuclear contamination during operation of nuclear steam turbine units. Additionally, in integral sidewall-type designs, cavities exist between the respective nozzle segment sidewalls which can become contaminated as well.

Accordingly, aspects of the invention provide for a steam turbine nozzle apparatus having flush apertures (or, holes). Aspects of the invention may also provide for methods of using the flush apertures to flush cavities within the steam turbine nozzle apparatus. Design and location of the apertures holes may allow for effective removal of contamination in cavities and gaps, by allowing fluid having a sufficiently high pressure to flow therethrough. The flush apertures may be designed and built into new (not yet completed) steam turbine nozzle assemblies, or may be retro-fitted to existing assemblies. Aspects of the invention may also provide for methods of flushing cavities and gaps in a steam turbine nozzle assembly from apertures accessible at the turbine's horizontal joint gap opening.

Figure 1:
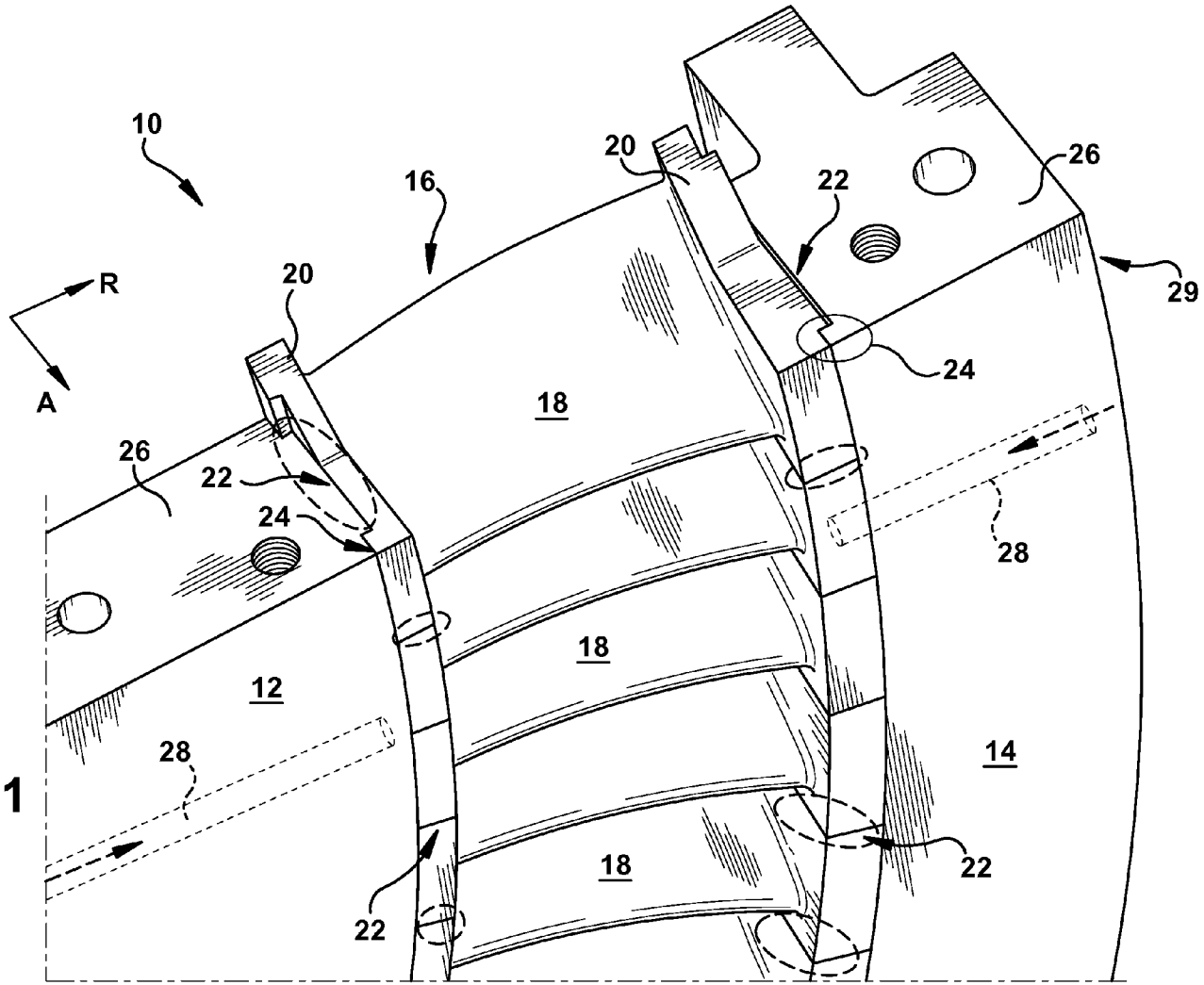
FIG. 1 shows a three-dimensional partial perspective view of a steam turbine nozzle assembly according to an embodiment of the invention.

Turning to FIG. 1, a three-dimensional partial perspective view of a steam turbine nozzle assembly 10 is shown according to an embodiment of the invention. As shown, this portion of steam turbine nozzle assembly 10 may include an inner diaphragm ring segment (or, inner segment) 12, an outer diaphragm ring segment (or, outer segment) 14, and a plurality of static nozzle blades 16 positioned between inner segment 12 and outer segment 14. As is known in the art, in one embodiment, each static nozzle blade 16 may include an airfoil 18 with integral sidewalls 20 (and, when constructed as a complete turbine stage, form an annulus of static nozzle blades). That is, in one embodiment, sidewalls 20 may be formed (e.g., cast) together with static nozzle airfoil 18. In another embodiment, as will be described further herein (e.g., with respect to FIG. 4), static nozzle airfoil 18 may be attached to bands positioned between inner segment 12 and outer segment 14, those bands being welded to inner segment 12 and outer segment 14, respectively.

With continuing reference to FIG. 1, also shown are cavities 22 (or, e.g., gaps, openings, spaces, etc.) between sidewalls 20, and inner segment 12 and outer segment 14, respectively. Cavities 22 are also shown between adjacent surfaces of sidewalls 20. It is understood that not all cavities 22 are labeled, however, an exemplary group of cavities 22 are highlighted by indicators such as arrows and dashed circles. In any case, cavities 22 may exist between adjacent surfaces of sidewalls 20, and/or between sidewalls 20 and diaphragm ring segments (inner segment 12 and/or outer segment 14). These cavities 22 may exist due, in part, to the limited welding accessibility of these areas of steam turbine nozzle assembly 10. For example, static nozzle blade 16 may be affixed to inner segment 12 or outer segment 14 via a weld connection (or, weld) 24 at the axial end (with respect to axis, "A") of the interface between sidewall 20 and inner segment 12 and outer segment 14, respectively. That is, welds 24 do not extend across an entire axial length of the interface between sidewalls 20 and diaphragm ring segments (e.g., inner 12 and outer 14). As such, these cavities 22 may become contaminated during operation of a steam turbine system including the steam turbine nozzle assembly 10. Additionally, these cavities 22 may become contaminated during the construction and/or repair of a steam turbine system including the steam turbine nozzle assembly 10. For example, in nuclear steam turbine systems, the high moisture content of steam passing through steam turbine nozzle assembly 10 may contribute to high-moisture conditions within cavities 22. The moisture in cavities 22 may accumulate over time, and in conventional steam turbine systems, this moisture does not have a way of exiting the system. Accumulated moisture in cavities 22 may cause performance-related issues as it reenters the steam path during operation of a nuclear steam turbine system. Further, when this accumulated water enters the steam path, it may cause erosion-related issues in downstream components (e.g., downstream turbine blades), as these downstream components are traditionally designed to interact with steam, and not water. Additionally, machine oil and other contaminants may become lodged in cavities 22 during construction and/or repair, causing e.g., diminished performance and/or increased maintenance costs.

Although in some applications (e.g., nuclear steam turbine applications) it may be practical to seal the cavities 22 located at the horizontal joint surface 26 (those between sidewalls 20 and inner 12 and outer 14 segments, respectively), this sealing process will not flush the cavities 22 of contaminants that may have entered during construction. Additionally, cavities 22 between the interfaces of adjacent sidewalls 20 may be inaccessible for sealing purposes due to the location and angle of airfoils 18. Accordingly, even in the case that a cavity 22 is sealed at the horizontal joint surface 26, contamination is still possible.

As such, the steam turbine nozzle assembly 10 shown according to embodiments of the invention further includes an aperture 28 (shown in phantom as hidden from this three-dimensional perspective) fluidly connected with cavities 22. In one embodiment, aperture 28 may extend radially (R-axis) entirely through a diaphragm ring segment. For example, as is described further herein, aperture 28 may extend from a first surface (e.g., a radially inward surface, not shown) of inner segment 12, through a body portion of inner segment 12, and to a second surface (e.g., a radially outward surface) of inner segment 12. In this case, aperture 28 may be configured to direct a fluid from the first surface to the second surface of inner segment 12, where the second surface of inner segment 12 is adjacent to cavity 22 between inner segment 12 and a sidewall 20. Further, as indicated herein, another aperture 28 may extend from a first surface 29 (e.g., a radially outward surface) of outer segment 14, through a body portion of outer segment 14, and to a second surface (e.g., a radially inward surface) of outer segment 14. In this case, aperture 28 may be configured to direct a fluid from first surface 29 to the second surface of outer segment 14, where the second surface of outer segment 14 is adjacent to cavity 22 between outer segment 14 and a sidewall 20. As indicated herein, and in contrast to conventional diaphragm ring segments, apertures 28 are fluidly connected with one or more nozzle blades 16. That is, apertures 28 may direct the flow of a pressurized fluid (e.g., water at approximately 50-100 psi), indicated by dashed arrows, toward nozzle blades 16 and through one or more cavities 22, thereby forcing contaminants out of those cavities 22.

Figure 2:
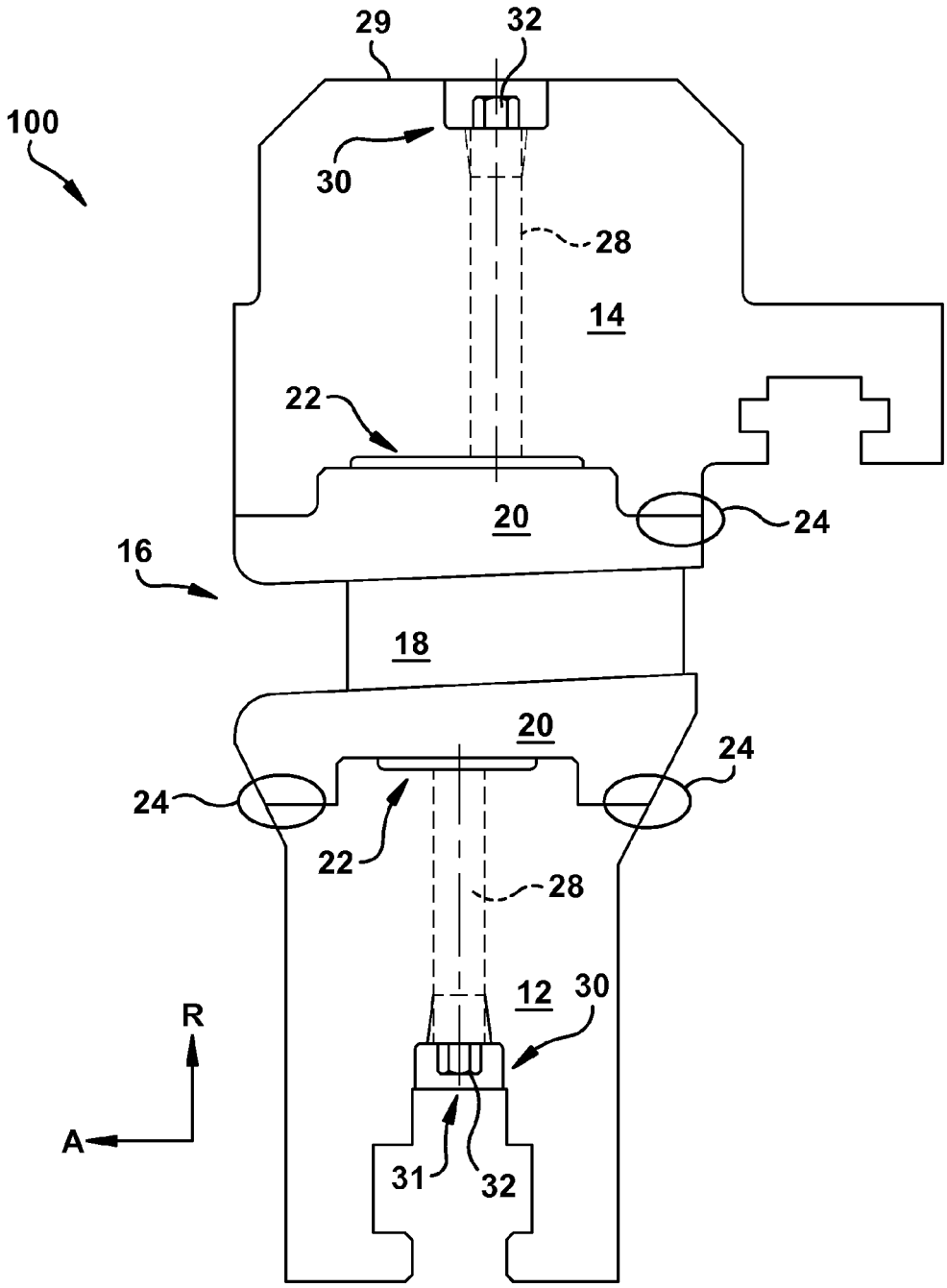
FIG. 2 shows a plan view of a top of a steam turbine nozzle assembly according to an embodiment of the invention.

Turning to FIG. 2, a plan view of a top of a steam turbine nozzle assembly 100 is shown according to embodiments of the invention. It is understood that steam turbine nozzle assembly 100 may include some substantially similar components as shown and described with reference to steam turbine nozzle assembly 10. In particular, steam turbine nozzle assembly 100 is shown including aperture 28 extending radially entirely through a diaphragm ring segment (e.g., a first aperture 28 extending through inner segment 12, and a second aperture 28 extending through outer segment 14). Also shown in FIG. 2 is a port 30 located at the first surface 29 of outer segment 14 and another port 30 located at first surface 31 of inner segment 12. Port 30 may be fluidly attached to aperture 28 (e.g., as a widened portion of aperture 28) and may be sized to allow for a plug 32 to fit therein. Port 30 may work as any conventional port in allowing access to aperture 28, for, e.g., flushing of aperture 28 with a fluid. As indicated herein, a fluid may be provided through port 30, flow through aperture 28, and flush contaminants out of cavities 22.

Figure 3:
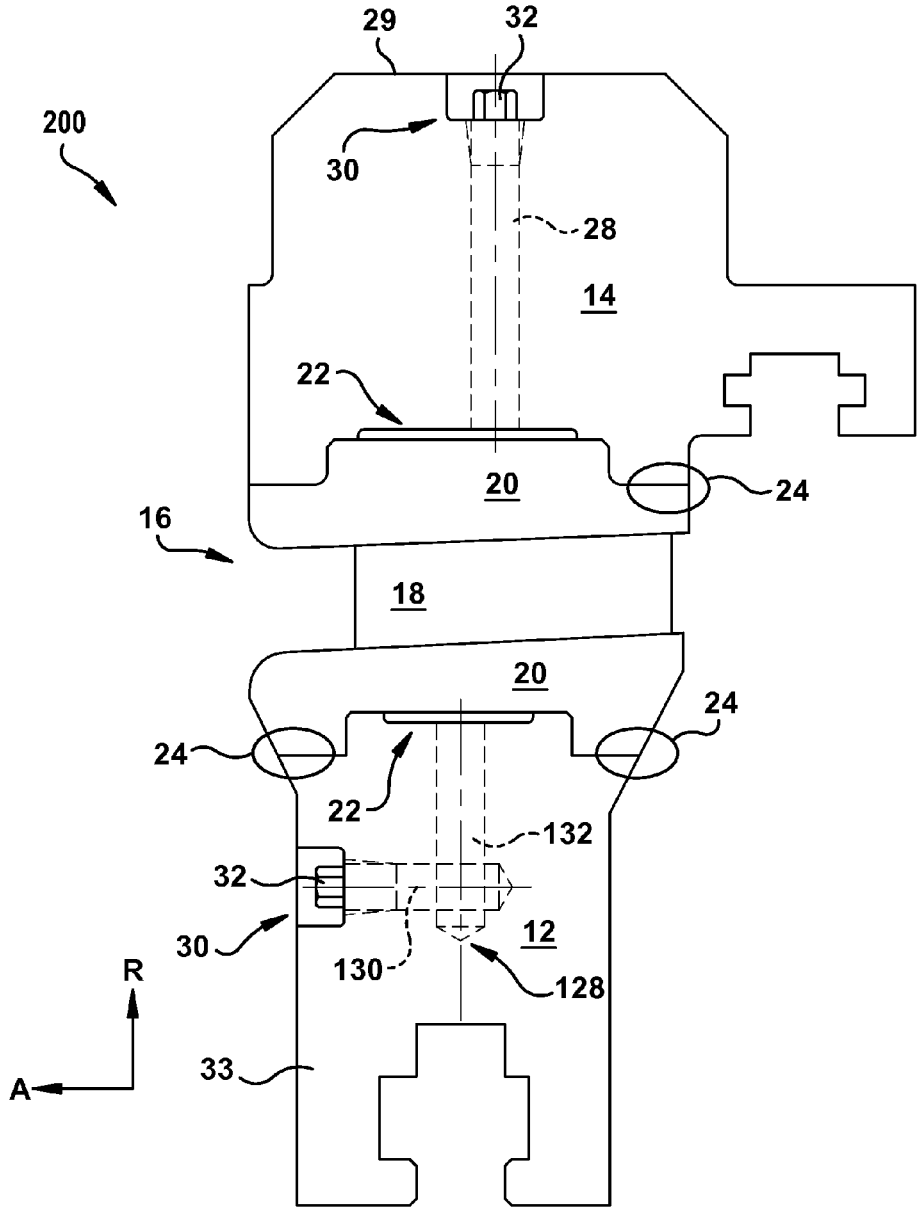
FIG. 3 shows a plan view of a top of a steam turbine nozzle assembly according to another embodiment of the invention.

Turning to FIG. 3, a plan view of a top of a steam turbine nozzle assembly 200 is shown according to alternate embodiments of the invention. In this embodiment, an alternate embodiment of an aperture 128 is shown including an axially extending portion 130 fluidly connected with a radially extending portion 132 (as a continuous channel). Axially extending portion 130 may be fluidly connected to an axially facing wall or surface 33 of inner segment 12 (with a port 30 and plug 32 similarly described with respect to FIG. 2). In one embodiment, axially facing surface 33 may be adjacent to the radially inner surface of inner segment 12. In this case, port 30 and plug 32 may be accessible from an axial side (surface 33) of inner segment 12, which may allow an operator (e.g., a human technician) to more easily provide a fluid through aperture 28 in order to flush cavity 22.

Figure 4:
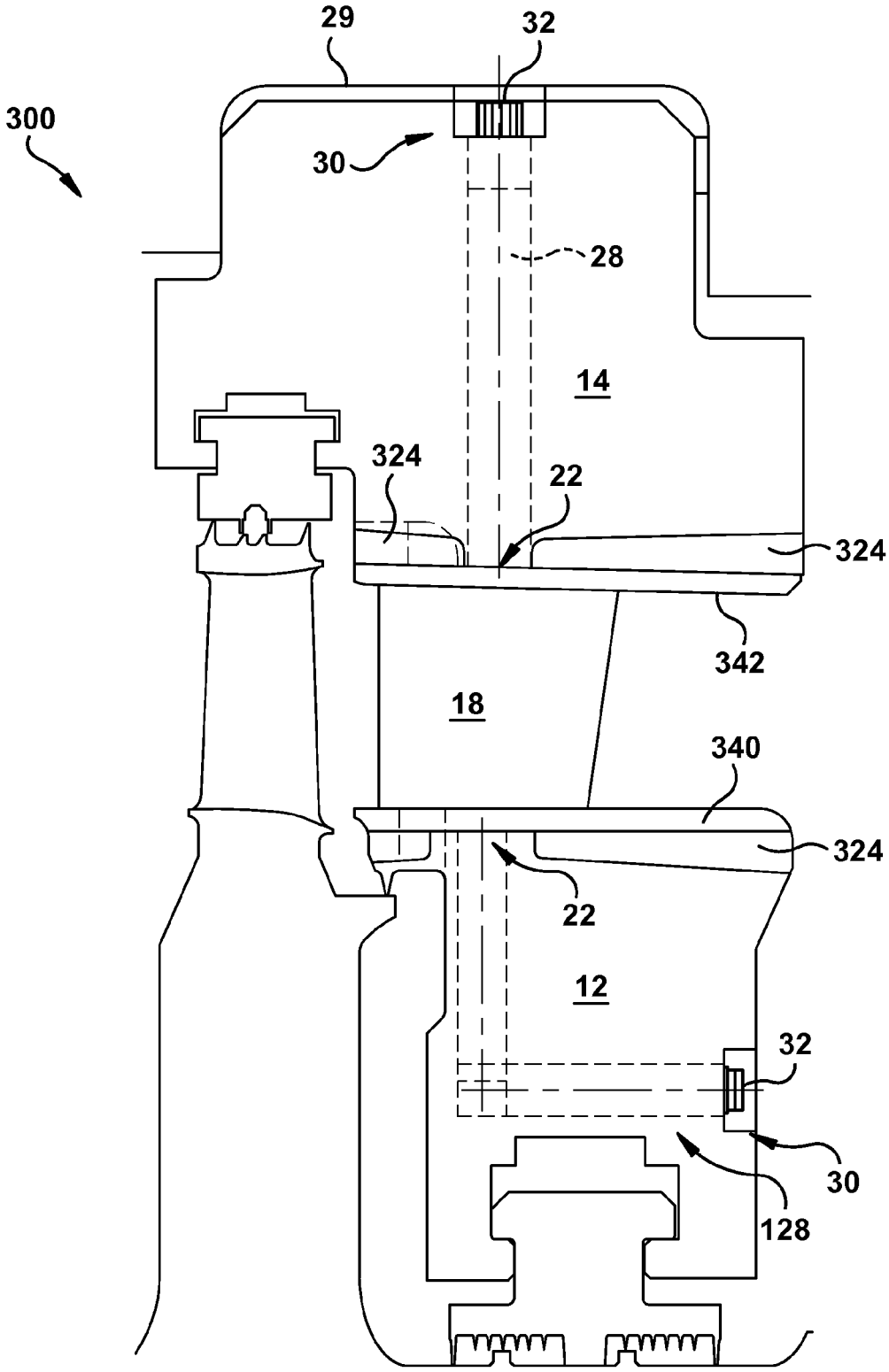
FIG. 4 shows a plan view of a top of a steam turbine nozzle assembly according to another embodiment of the invention.

Turning to FIG. 4, a plan view of a top of a steam turbine nozzle assembly 300 is shown according to alternate embodiments of the invention. In this embodiment, airfoil 18 is affixed to inner segment 12 and outer segment 14 via bands (inner 340 and outer 342, respectively) and welds 324. In this embodiment, cavities 22 may exist between portions of inner segment 12 and inner band 340, and outer segment 14 and outer band 342, respectively. Due to the limited accessibility of the interface between bands (e.g., inner 340 and outer 342) and diaphragm segments (e.g., inner 12 and outer 14), welding across the entire interface may not be possible. In the areas where welding is not possible, cavities 22 may exist, which may benefit from the flushing apertures (e.g., apertures 28, 128) shown and described herein.

Figure 5:
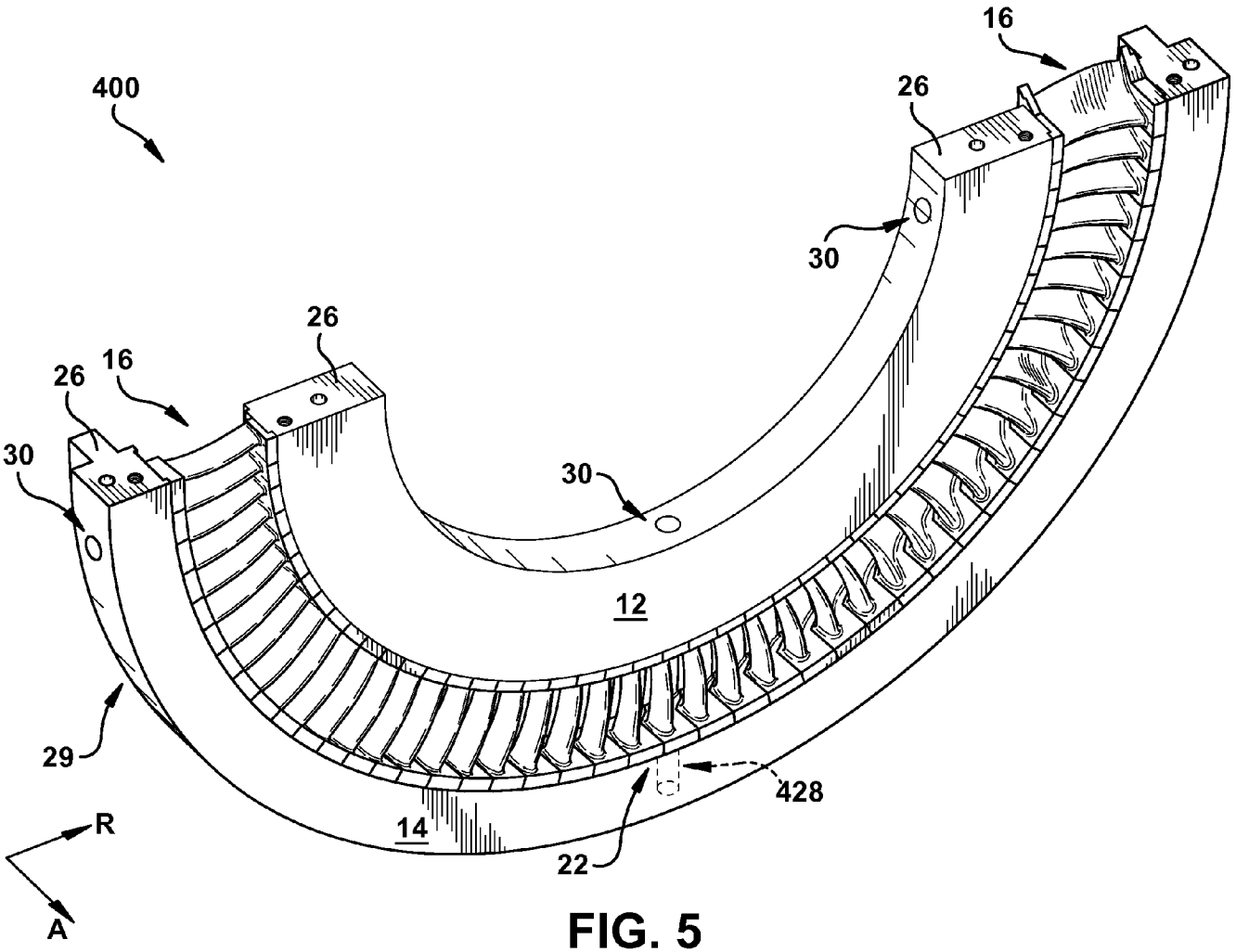
FIG. 5 shows a three-dimensional perspective view of a portion of a steam turbine nozzle assembly according to an embodiment of the invention.

Turning to FIG. 5, a three-dimensional perspective view of a portion of a steam turbine nozzle assembly 400 is shown according to an embodiment of the invention. As shown, many components (e.g., inner segment 12, outer segment 14, nozzle blades 16, ports 30, etc.) of steam turbine nozzle assembly 400 may be substantially similar to those shown and described with reference to FIGS. 1-4. Steam turbine nozzle assembly 400 further includes a drainage aperture 428 within outer segment 14. Drainage aperture 428 may be in fluid connection with a cavity 22 (e.g., a cavity between sidewall 20 and outer segment 14) and a radially exterior surface of outer segment 14 (e.g., surface 29). That is, drainage aperture 428 may extend an entire radial length of outer segment 14. Drainage aperture 428 may be distinct from apertures 28, 128 shown and described herein, in that drainage aperture 428 may be configured primarily to direct fluid away from the nozzle blades 16 and out of the system. In this light, drainage aperture 428 may or may not be configured with a port and/or plug. In one embodiment, drainage aperture 428 may be configured to remain open, allowing for the flow of excess water away from nozzle blades 16 (through the body of outer segment 14). In one embodiment, drainage aperture 428 may have a smaller diameter than other apertures described herein (e.g., apertures 28 and/or 128). In one embodiment, drainage aperture 428 may be located at approximately the bottom dead center portion of outer segment 14, allowing for efficient removal of excess water from the system, aided by gravitational forces. As discussed herein, removal of excess water from the steam turbine (e.g., a nuclear steam turbine) during operation may prevent cavities 22 from filling with water and consequently expelling that water back into the steam path. While drainage aperture 428 is shown located at approximately the bottom dead center portion of outer segment, drainage aperture 428 may be located in other portions of outer segment 14 as well. Further, multiple drainage apertures 428 may be used in some embodiments of the invention.

It is understood that while terms such as "axial" and "radial" are used for reference, such terms are not meant to be limiting. For example, it is understood that apertures (e.g., apertures 28, 128 or 428) may be formed in inner diaphragm ring segment 12 and/or outer diaphragm ring segment 14 (e.g., via boring, drilling, etc.) while components describe herein are disassembled. Accordingly, it is within the scope of aspects of the invention that terms such as, "axially inner" and "axially outer" may be substituted for terms like, "first surface" and "second surface", respectively.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine diaphragm assembly comprising:

an inner diaphragm ring segment;

an outer diaphragm ring segment;

a static nozzle blade positioned between the inner diaphragm ring segment and the outer diaphragm ring segment;

a first cavity between the static nozzle blade and the inner diaphragm ring segment;

wherein the inner diaphragm ring segment includes a first aperture fluidly connected with the first cavity, wherein the first aperture includes an inlet at a radially inward surface of the inner diaphragm ring segment and an outlet at a outward surface of the inner diaphragm ring segment; and a second cavity between the static nozzle blade and the outer diaphragm ring segment;

wherein the outer diaphragm ring segment includes a second aperture fluidly connected with the second cavity, wherein the second aperture includes an inlet at a radially outward surface of the outer diaphragm ring segment and an outlet at a radially inward surface of the outer diaphragm ring segment, and wherein the inlet and the outlet of the first aperture are fluidly separated from the inlet and the outlet of the second aperture.

2. The steam turbine diaphragm assembly of claim 1, wherein the first aperture extends radially entirely through the inner diaphragm ring segment.

3. The steam turbine diaphragm assembly of claim 1, wherein the first aperture includes an axially extending portion fluidly connected to an axially facing wall of the inner diaphragm ring segment.

4. The steam turbine diaphragm assembly of claim 1, wherein the second aperture extends radially entirely through the outer diaphragm ring segment.

5. The steam turbine diaphragm assembly of claim 1, wherein the first aperture extends to an outer wall of the inner diaphragm ring segment, and the first aperture further includes a port located at the outer wall.

6. The steam turbine diaphragm assembly of claim 5, wherein the outer wall is one of a radially facing outer wall or an axially facing outer wall.

7. The steam turbine diaphragm assembly of claim 5, further comprising a drainage aperture within the outer diaphragm ring segment, the drainage aperture in fluid connection with the first cavity and located at approximately a bottom dead center portion of the outer diaphragm ring segment.

8. The steam turbine diaphragm assembly of claim 7, wherein the drainage aperture has a smaller diameter than the first aperture.

9. The steam turbine diaphragm assembly of claim 1, wherein the first cavity extends at least a portion of an axial length of the static nozzle blade.

10. A steam turbine diaphragm assembly comprising:

an inner diaphragm ring;

an outer diaphragm ring;

an annulus of static nozzle blades positioned between the inner diaphragm ring and the outer diaphragm ring;

an inner cavity between the annulus of static nozzle blades and the inner diaphragm ring; and an outer cavity between the annulus of static nozzle blades and the outer diaphragm ring;

wherein the inner diaphragm ring includes a first aperture fluidly connected with the inner cavity, and the outer diaphragm ring includes a second aperture fluidly connected with the outer cavity, wherein the first aperture and the second aperture each extend radially entirely through the inner diaphragm ring and the outer diaphragm ring, respectively, wherein the first aperture includes an inlet at a radially inward surface of the inner diaphragm ring and an outlet at a outward surface of the inner diaphragm ring; and wherein the second aperture includes an inlet at a radially outward surface of the outer diaphragm ring and an outlet at a radially inward surface of the outer diaphragm ring, and wherein the inlet and the outlet of the first aperture are fluidly separated from the inlet and the outlet of the second aperture.

11. The steam turbine diaphragm assembly of claim 10, wherein each of the first aperture and the second aperture extend to an outer wall of the inner diaphragm ring and the outer diaphragm ring, respectively, and each of the first aperture and the second aperture further include a port.

12. The steam turbine diaphragm assembly of claim 10, further comprising a drainage aperture within the outer diaphragm ring segment, the drainage aperture in fluid connection with the outer cavity and located at approximately a bottom dead center portion of the outer diaphragm ring.

13. The steam turbine diaphragm assembly of claim 12, wherein the drainage aperture has a smaller diameter than the second aperture.

14. The steam turbine diaphragm assembly of claim 10, wherein each of the inner cavity and the outer cavity, extend at least a portion of an axial length of the static nozzle blade.

15. A steam turbine diaphragm assembly comprising:

an inner diaphragm ring;

an outer diaphragm ring;

an annulus of static nozzle blades positioned between the inner diaphragm ring and the outer diaphragm ring;

an inner cavity between the annulus of static nozzle blades and the inner diaphragm ring; and an outer cavity between the annulus of static nozzle blades and the outer diaphragm ring;

wherein the inner diaphragm ring includes a first aperture fluidly connected with the inner cavity, and the outer diaphragm ring includes a second aperture fluidly connected with the outer cavity, wherein the first aperture and the second aperture each extend radially entirely through the inner diaphragm ring and the outer diaphragm ring, respectively.

* * * * *